United States Patent [19]

Takahashi et al.

[11] 4,047,264

[45] Sept. 13, 1977

[54] SEPARABLE SLIDE FASTENER

[75] Inventors: Kihei Takahashi, Uozu; Yositaka Higuchi, Kami-ichimachi, both of Japan

[73] Assignee: Yoshida Kogyo Kabushiki Kaisha, Japan

[21] Appl. No.: 581,811

[22] Filed: May 29, 1975

Related U.S. Application Data

[62] Division of Ser. No. 461,735, April 17, 1974, Pat. No. 3,900,926.

[30] Foreign Application Priority Data

Apr. 20, 1973 Japan ..... 48-48146[U]

[51] Int. Cl.[2] ..... A44B 19/36

[52] U.S. Cl. ..... 24/205.11 R

[58] Field of Search ..... 24/205.15 R, 205 R, 24/205.11 R

[56] References Cited

U.S. PATENT DOCUMENTS

| | | | |
|---|---|---|---|
| 2,069,655 | 2/1937 | Kispert | 24/205.15 R |
| 2,621,387 | 12/1952 | Williams | 24/205.15 R |
| 2,701,903 | 2/1955 | Williams | 24/205.15 R |
| 2,728,125 | 12/1955 | Wild | 24/205.15 R |
| 2,784,473 | 3/1957 | Morin | 24/205.11 R |
| 2,928,156 | 3/1960 | Doelter | 24/205.15 R |
| 3,583,043 | 6/1971 | Vorsteher | 24/205 |
| 3,618,178 | 11/1971 | Hansen | 24/205.15 R |

FOREIGN PATENT DOCUMENTS

| | | | |
|---|---|---|---|
| 735,942 | 11/1932 | France | 24/205.11 R |
| 715,691 | 12/1931 | France | 24/205.11 R |
| 870,231 | 4/1954 | Germany | 24/205 R |
| 370,317 | 4/1932 | United Kingdom | 24/205.11 R |

*Primary Examiner*—Bernard A. Gelak

*Attorney, Agent, or Firm*—Bucknam and Archer

[57] ABSTRACT

A slider aligning device is disclosed for use in a separable slide fastener of the class comprising a pair of stringers having longitudinal rows of interfitting fastener elements on their opposed edges respectively, and a pair of sliders arranged reversely to each other on the rows of fastener elements for longitudinal movement therealong to engage and disengage the same. The aligning device includes a pair of recesses formed inconspicuously at the contracted end of one of the sliders, and a pair of tongues formed correspondingly at the opposed contracted end of the other slider. The tongues are so shaped and sized as to fit neatly in the respective recesses when the contracted ends of the two sliders are brought into contact with each other, so that the sliders can be held in correct alignment during insertion or removal of a pin member at one end of one of the stringers into or out of the guide channels of the respective sliders. The device is adaptable for a separable slide fastener of the type incorporating a box and pin coupling.

1 Claim, 9 Drawing Figures

SEPARABLE SLIDE FASTENER

This is a division, of application Ser. No. 461,735 filed Apr. 17, 1974, now U.S. Pat. No. 3,900,926.

BACKGROUND OF THE INVENTION

This invention relates generally to slide fasteners, and in particular to separable slide fasteners wherein the pair of stringers are made completely separable from each other, as for use with windbreakers and other garments. More particularly, the invention is directed to an aligning device in the slide fastener of the class under consideration whereby the fastener stringers can be coupled and uncoupled with extreme ease.

There are two well known types of separable slide fasteners, one which permits the fastener to be opened from one end only, and another known as the "two-way" or "double acting" type which permits the fastener to be opened from both ends. The former type of fasteners usually have a single slider in combination with what is generally referred to as the box and pin separable coupling, whereas the latter type of fasteners incorporate a pair of sliders arranged reversely with respect to each other on the rows of interlocking fastener elements. In either type of fasteners, it is necessary that the slider and the box member, or the pair of sliders, be held in correct alignment with each other on one of the fastener stringers during insertion or removal of the pin member on the other stringer into or out of their guide channels.

A wide variety of aligning devices have heretofore been suggested and used to this end. U.S. Pat. No. 2,069,655, for example, discloses a device wherein the slider is provided with an extension of U-shaped cross section so as to fit over part of the box member. The slider of such configuration inevitably becomes bulky in size, uneconomical, and unfavorable in appearance. French Pat. No. 735,942 and U.S. Pat. Nos. 2,728,125 and 3,583,043 are more or less identical in that they suggest devices wherein interengaging notch or notches and projection or projections are formed respectively at the opposed ends of the slider and the box member or of the pair of sliders. All these devices are unsatisfactory because the interengaging notch and projection are too conspicuous, requiring undue modification in the external appearance of the sliders. Further, according to U.S. Pat. No. 2,302,239 and Japanese Patent Publication No. 47-9388, the box member has a projecting pin portion adapted to enter a groove or grooves formed internally of the slider, but this arrangement is unapplicable to the two-way type of separable fasteners.

SUMMARY OF THE INVENTION

In view of the listed drawbacks of the prior art, it is an object of this invention to provide an improved aligning device adaptable for use both with the separable slide fastener of the two-way type and with those of the usual box-and-pin-coupling type, although the device may be better suited for use with the former type of fasteners.

Another object of the invention is to provide an aligning device of the character described, whereby the manipulation of the separable slide fasteners is materially simplified, particularly in connection with insertion or removal of a pin member on one of the fastener stringers into or out of a pair of sliders on the other stringer.

A further object of the invention is to provide an aligning device of the character described, which requires minimum modification in the shape or size of the sliders, such that the general appearance of the conventionally known sliders is substantially retained intact.

A still further object of the invention is to provide an aligning device of the character described, which is compact, inexpensive and endurable in construction and which permits the sliders to be correctly and securely aligned with each other over prolonged periods of use.

According to a preferred embodiment of this invention, there is disclosed an aligning device for a separable slide fastener of the two-way type having a pair of sliders arranged reversely with respect to each other on rows of interlocking fastener elements arranged along the opposed edges of a pair of stringer tapes respectively. Typically, the device comprises a pair of recesses formed at that end of one of the sliders disposed opposite to the other slider, in such a way that the recesses are substantially invisible from the outside of the slider, and a pair of tongues formed at the corresponding end of the otherslider to be neatly received in the respective recesses, whereby the two sliders can be exactly aligned one with respect to the other.

The features which are believed to be novel and characteristic of this invention are set forth with particularity in the appended claims. The invention itself, however, as well as the further objects and advantages thereof, will be best understood from the following description taken in connection with the accompanying drawings which illustrate some preferred embodiments of the invention and in which like reference characters denote corresponding parts of the several views, and wherein.

DESCRIPTION OF THE PREFERRED EMBODIMENTS

Figure 1:
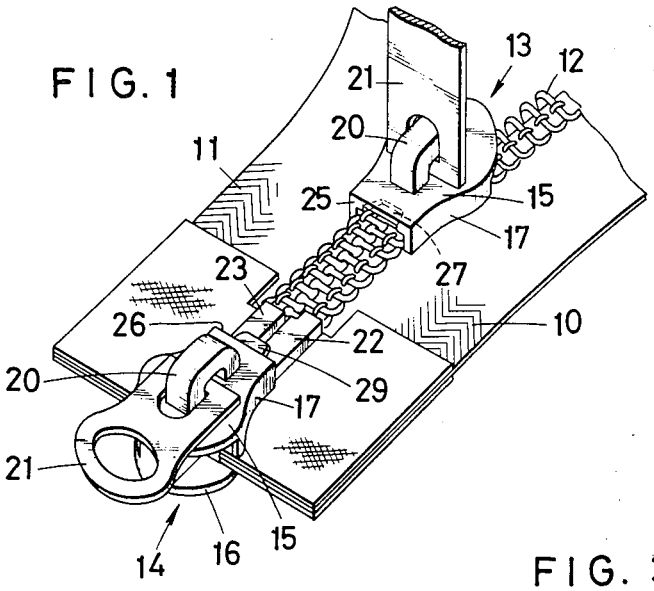
FIG. 1 is a fragmentary perspective view of a separable slide fastener of the two-way type configured in accordance with the novel concepts of this invention.

By way of a first preferred embodiment of this invention, there is specifically illustrated in FIGS. 1 to 6 a separable slide fastener of the aforesaid two-way or double acting type incorporating the novel concepts of the invention. As best illustrated in FIG. 1, the two-way separable fastener comprises a pair of stringer tapes 10 and 11 carrying longitudinal rows of spaced-apart interlocking fastener elements 12 of any known or suitable type on their opposed beaded edges respectively. In order to permit the fastener to be opened from either end, there are arranged on the rows of fastener elements 12 a pair of sliders 13 and 14 which are disposed reversely from each other and are adapted for longitudinal movement along the fastener elements for engaging and disengaging the same in the usual manner.

Figure 2:
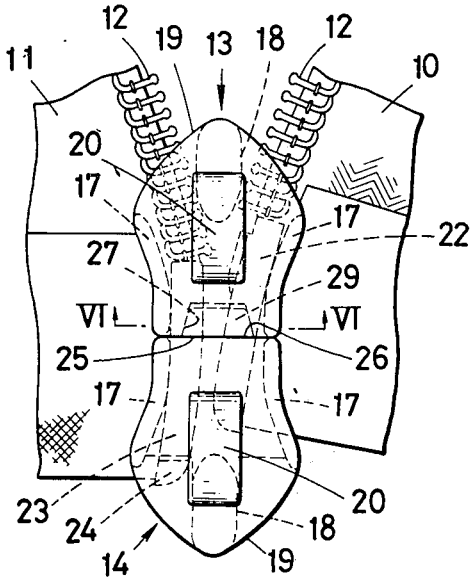
FIG. 2 is a fragmentary top plan view of the separable slide fastener of FIG. 1, in which the pull tabs are omitted and in which the pair of sliders are shown in their properly aligned position.
Figure 3:
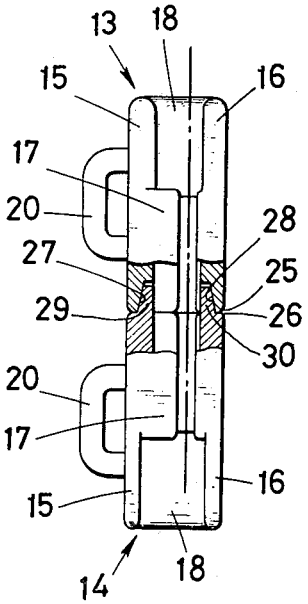
FIG. 3 is a side elevational view, partly in section, of the pair of sliders aligned as in FIG. 2.

As seen in FIGS. 2 and 3, each of the sliders 13 and 14 has a body portion comprising a pair of spaced-apart wings or plate members 15 and 16 having flanges 17 along their marginal edges and interconnected through an integral nock or web 18 at their flared end 19 so as to define a generally Y-shaped guide channel through the slider. Such guide channels of the respective sliders are adapted to permit the rows of fastener elements 12 to be threaded therethrough for their engagement or disengagement. Each of the sliders 13 and 14 is further provided with a longitudinally extending lug 20 on its top wing 15 to which there is pivotally and slidably attached a finger piece or pull tab 21 for use in manipulating the slider.

A pair of pin members 22 and 23 are attached to the opposed edges of the respective stringer tapes 10 and 11 at one end of the fastener. As indicated in FIG. 2, the pin member 23 includes an integral stop portion 24 for limiting the movement of the slider 14 at the said one end of the fastener and for retaining the sliders 13 and 14 on the stringer tape 11 after it has been completely separated from the other stringer tape 10. It may be noted from FIGS. 2 and 3 that during insertion or removal of the pin member 22 on the stringer tape 10 into or out of the sliders 13 and 14, the contracted end 25 of the slider 13 is to be held in neat contact with a similar contracted end 26 of the other slider 14, so that the two sliders will be completely aligned with respect to each other.

In order to cause such complete alignment of the sliders 13 and 14, the top and bottom wings 15 and 16 of the slider 13 are both recessed internally at its contracted end 25, as indicated by the numerals 27 and 28 respectively. Each of these recesses 27 and 28 is of generally trapezoidal shape when seen in a plan view as in FIG. 2, tapering inwardly both in width and thickness (refer also to FIG. 3). It will also be noted from FIG. 3 that the recesses 27 and 28 are both open through the inside surfaces of the respective wings 15 and 16 of the slider 13 but not through their outside surfaces.

Correspondingly, the contracted end 26 of the other slider 14 has integral tongues 29 and 30 protruding from its top and bottom wings 15 and 16 respectively. These tongues 29 and 30 correspond both in shape and size to the recesses 27 and 28, and as will be seen from FIG. 3, the inside surfaces of the tongues 29 and 30 are on the same planes as the inside surfaces of the respective top and bottom wings of the slider 14. Hence, as illustrated in FIGS. 2 and 3, the tongues 29 and 30 of the slider 14 are to be neatly received in the respective recesses 27 and 28 of the slider 13 when the contracted ends 25 and 26 of the two sliders are brought into contact with each other, so that the sliders can be held in completely aligned relationship to each other.

Figure 4:
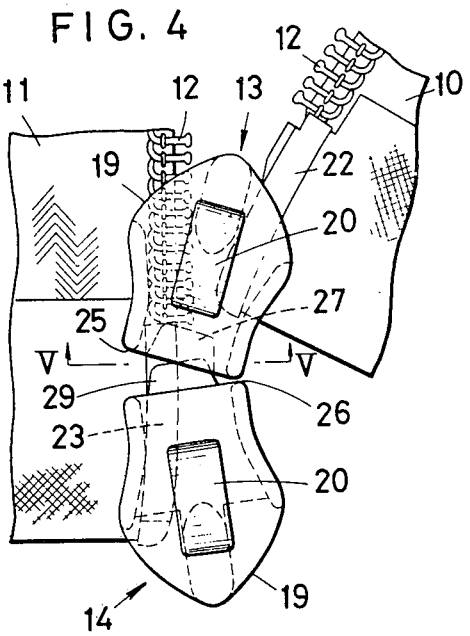
FIG. 4 is a view similar to FIG. 2 which is explanatory of the positions which the respective sliders will assume when a pin member is about to be inserted into their guide channels.
Figure 5:
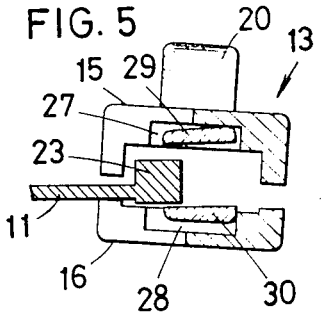
FIG. 5 is a sectional view taken along the plane of line V—V in FIG. 4.
Figure 6:
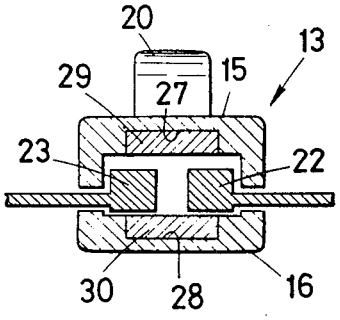
FIG. 6 is also a sectional view taken along the plane of line VI—VI in FIG. 2.

Described hereinbelow, with reference to FIGS. 4 to 6 in particular, is the functioning of the improved two-way separable slide fastener according to the invention. Let it be assumed that the stringers of the fastener have been completely separated from each other and that the pin member 22 on the stringer tape 10 is now about to be inserted into the guide channels of the respective sliders 13 and 14 for joining the corresponding ends of the stringers together, as illustrated in FIG. 4. The sliders 13 and 14 may not at first be aligned with respect to each other and may further be partly displaced from the plane of the stringer tape 11, as illustrated in FIGS. 4 and 5, even though the tongues 29 and 30 of the slider 14 may be partly received in the respective recesses 27 and 28 of the slider 13.

However, as the pin member 22 is threaded through the guide channels of the sliders 13 and 14, the slider 13 can be forced into correct alignment with the slider 14 since then the recesses 27 and 28 of the former completely engage the respective tongues 29 and 30 of the latter. Thus, as illustrated in FIGS. 2 and 6, the pin member 22 can now be smoothly inserted into and through the guide channel of the slider 13 and further into the guide channel of the slider 14 until the pin member is properly positioned therein to permit the correct engagement of the fastener elements 12 upon movement of the slider 13 away from the slider 14.

It is particularly noteworthy that in this embodiment of the invention, both wings 15 and 16 of each of the sliders 13 and 14 are provided with their own recesses 27 and 28 or tongues 29 and 30. This arrangement permits dual interengagement, so to say of the sliders 13 and 14, so that these sliders can be securely prevented from any misalignment relative to each other as the pin member 22 is inserted into or removed from their guide channels.

Figure 7:
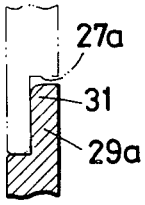
FIG. 7 is a fragmentary sectional view similar to FIG. 3 showing another preferred embodiment of the invention.

In FIG. 7 there is illustrated a modification of the preceding embodiment of FIGS. 1 to 6, in which the tongues 29 and 30 protruding from the respective wings 15 and 16 of the slider 14 are replaced by those which have unvarying thickness and width, that is, are not tapered like the tongues 29 and 30. Only one, 29*a*, of such modified tongue is illustrated in FIG. 7 for the sake of simplicity, together with a correspondingly modified recess 27*a* to be formed in the other slider. In order to permit the tongue 29*a* to be easily received in the recess 27*a*, its leading edges are suitably rounded as indicated at 31 in the drawing. It is, of course, assumed that the other tongue is of identical shape.

Figure 8:
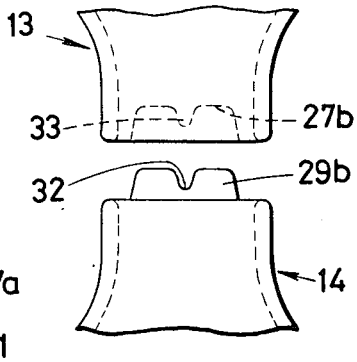
FIG. 8 is a fragmentary top plan view showing still another preferred embodiment of the invention.

FIG. 8 illustrates another preferred embodiment of the invention, in which the tongue 29*b* protruding from each of the wings 15 and 16 of the slider 14 has a notch 32 formed centrally in its leading end. There is correspondingly formed an integral protuberance 33 in the recess 27*b* in each of the wings 15 and 16 of the other slider 13, the protuberance 33 being shaped and sized to be neatly received in the notch 32 in the tongue 29*b* upon contact of the contracted ends 25 and 26 of the sliders 13 and 14. The mating notch 32 and protuberance 33 are calculated to ensure still more correct alignment of the sliders 13 and 14 which would otherwise be insufficient due to the presence of recesses 27, 28 during insertion or removal of the pin member 22 into or out of their guide channels.

Figure 9:
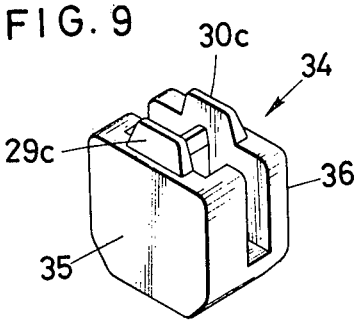
FIG. 9 is a perspective view of the box member of a box and pin separable coupling constructed acording to the concepts of the invention.

As illustrated in FIG. 9, the concepts of this invention are applicable to a separable slide fastener of the usual box-and-pin-coupling type whereby the fastener can be opened from one end only. Only the box member 34 of the box and pin separable coupling is illustrated in FIG. 9, but it will be apparent that this box member is to be used to render the slider 14 stationary in the first described embodiments of FIGS. 1 to 6. Like the slider 14, the box member 34 has a pair of tongues 29*c* and 30*c* formed integral with its top and bottom plate portions 35 and 36, respectively, at their ends to be disposed opposite to the contracted end 25 of the slider 13. This box member is to be employed in combination with the slider 13 in the well known manner. Although the tongues 29*c* and 30*c* as illustrated in FIG. 9 are shaped exactly like the tongues 29 and 30 shown previously in FIGS. 2 and 3 in particular, it will be understood that they can be modified in shape like the examples of FIGS. 7 and 8, with corresponding modifications in the shape of the recesses to be formed in the cooperating slider 13.

While the separable slide fastener according to this invention has been shown and described hereinbefore in terms of some preferred embodiments thereof, it is understood that the invention itself is not to be restricted by the exact showing of the drawings or the description thereof. In the first described embodiment of the invention, for example, the recesses 27 and 28 may be formed in the slider 14 and the tongues 29 and 30 on the slider 13, without departing from the scope of this invention. It is therefore appropriate that the invention be constred broadly and in a manner consistent with the fair meaning or proper scope of the following claims.

What is claimed is:

1. In a separable slide fastener of the class including a pair of stringers having longitudinal rows of interlocking fastener elements on their opposed edges respectively, a slider arranged on said rows of fastener elements for longitudinal movement therealong to engage and disengage the same, said slider having a pair of spaced-apart and interconnected wings disposed to define a generally Y-shaped guide channel therethrough, a box member arranged on one end of one of said stringers for limiting the movement of said slider, said box member having a pair of spaced-apart and interconnected plate portions having a guide channel therein, and a pin member arranged on the corresponding end of the other stringer for insertion through the guide channels of said slider and said box member, the improvement comprising means defining a pair of recesses and a pair of tongues having a configuration complementary to corrsponding recesses and disposed for insertion thereinto, each recess and corresponding tongue being disposed on respective confronting ends of said box member and slider, said tongues and recesses being generally trapezoidal to aid the in the alignment of said slider and box member when the tongues are received in the recesses, thereby aiding the insertion and removal through said guide channels of said pin member, said tongues and recesses each being positioned in generally central symmetrical relation to a corresponding one of said confronting ends of the box member and slider, each tongue being disposed for fully concealed insertion into a corresponding recess.

* * * * *